United States Patent [19]

Tanaka et al.

[11] Patent Number: 4,539,281

[45] Date of Patent: Sep. 3, 1985

[54] METHOD OF FORMING DICHROMATIC COPY IMAGES

[75] Inventors: Susumu Tanaka, Aichi; Kaoru Takebe, Toyokawa, both of Japan

[73] Assignee: Minolta Camera Kabushiki Kaisha, Osaka, Japan

[21] Appl. No.: 557,225

[22] Filed: Nov. 30, 1983

[30] Foreign Application Priority Data

Dec. 2, 1982 [JP] Japan ..... 57-212287

[51] Int. Cl.[3] ..... G03G 13/01; G03G 13/09

[52] U.S. Cl. ..... 430/45; 430/31; 430/42; 430/122

[58] Field of Search ..... 430/31, 45, 122, 42

[56] References Cited

U.S. PATENT DOCUMENTS

| | | | |
|---|---|---|---|
| 4,038,544 | 7/1977 | Shenoy | 430/31 X |
| 4,039,831 | 8/1977 | Lehmann | 430/42 X |
| 4,045,219 | 8/1977 | Bean | 430/42 X |
| 4,078,929 | 3/1978 | Gundlach | 430/31 X |
| 4,250,239 | 2/1981 | Sakai | 430/42 |
| 4,264,185 | 4/1981 | Ohta | 355/4 |
| 4,308,821 | 1/1982 | Matsumoto et al. | 118/645 |
| 4,310,610 | 1/1982 | Sakai | 430/42 |
| 4,335,194 | 6/1982 | Sakai | 430/31 X |
| 4,384,033 | 5/1983 | Sakai | 430/31 X |
| 4,493,881 | 1/1985 | Mitchell et al. | 430/31 X |

*Primary Examiner*—Roland E. Martin

*Attorney, Agent, or Firm*—Wenderoth, Lind & Ponack

[57] ABSTRACT

The invention disclosed concerns a method of forming dichromatic copy images. An electrostatic latent image having a first image portion and a second image portion is formed. The first image portion is developed by a first magnetic brush developing device using at least a magnetic toner of first color triboelectrically chargeable to a specific polarity. The second image portion is developed by a second magnetic brush developing device using a mixture of a magnetic carrier substantially not triboelectrically chargeable with the magnetic toner and a non-magnetic toner of a second color triboelectrically chargeable to a polarity opposite to that of the magnetic toner by contact with the magnetic carrier.

6 Claims, 14 Drawing Figures

METHOD OF FORMING DICHROMATIC COPY IMAGES

BACKGROUND OF THE INVENTION

1. Field of the Invention

The present invention relates to a method of forming dichromatic copy images free of fog and mingling of colors.

2. Description of the Prior Art

To meet the need for diverse modes of processing information in recent years, copying machines have been developed for making copies of composite images by successively or simultaneously forming on the surface of an electrostatic latent image bearing member a first latent image and a second latent image having an opposite polarity to the first image, or having the same polarity as the first image but different therefrom in potential, developing the first and second latent images thus formed as a composite image to obtain a toner image, and transferring the toner image onto the surface of a copy material. Moreover, copying machines capable of producing dichromatic copy images from a dichromatic original, for example from an original bearing a red colored images and black colored images have also been proposed.

Although it is quite apparent in a case of obtaining dichromatic copy images from a dichromatic original, there is frequent necessity also for the above described composite images to develop the first and second latent images with different colors of toner respectively for the purpose of editing and discrimination. This dichromatic development is normally performed with use of two developing devices wherein a latent image corresponding to an image portion of first color is initially developed by a toner of first color and then developing a latent image corresponding to an image portion of second color with a toner of second color. However, when the magnetic brush development method is utilized in particular, a small quantity of the toner of first color developed by the first developing device is scraped off during the development by the second developing device so that the toner of first color mixes into the second developing device which accommodates the toner of second color. In this case, the first and second developing devices generally employ two component developer of a mixture of toner and carrier triboelectrically chargeable to opposite polarities. Accordingly, when the toner of first color intrudes into and is mixed into the second developing device, it charges triboelectrically with the carriers thereby making the charging characteristic unstable and in consequence, the charging polarity of the toner of second color changes to cause mingling of colors. As a result, reproduction of image with mingling of colors cannot be avoided but also the scattering of toner and fogs are bound to occur so that it is quite difficlut to obtain fine dichromatic images.

For this purpose, there has been proposed in Japanese Unexamined Laid-open Patent Application No. SHO 56-55971 a dichromatic developing method wherein first and second magnetic developing devices are provided adjacent one another and the toner of first color is prevented from mixing into the second developing device by making the magnetic force of the second developing device stronger than the first. In Published Unexamined Japanese Patent Application No. SHO 56-130773, a device for separating toner mixed into the second developing device is provided to prevent mingling of colors. However, these measures taken to prevent mingling of colors are all structural and cannot avoid making the developing device complicated.

SUMMARY OF THE INVENTION

The main object of the present invention is to provide a method of forming dichromatic copy images capable of producing dichromatic images free from fog and mingling of colors.

Another object of the present invention is to provide a method of forming dichromatic copy images with use of a novel developer which prevents toners of different colors from mingling without deteriorating the characteristic of the developer.

Another object of the present invention is to provide a method of forming dichromatic copy images by the use of a simple arrangement under conditions which are settable easily.

Still another object of the present invention is to provide a method of forming dichromatic copy images in which an electrostatic latent image formed can be satisfactorily developed in two colors by two developing devices to give a distinct copy image free of fog and mingling of colors.

These and other objects of the present invention can be fulfilled by a method of forming dichromatic copy images comprising the steps of forming an electrostatic latent image having an image portion to be developed in a first color and an image portion to be developed in a second color, and developing this electrostatic latent image with first and second magnetic brush developing devices by which the image portion of first color is developed by the first magnetic brush developing device using a magnetic toner triboelectrically chargeable to a specific polarity and the image portion of second color is developed by the second magnetic brush developing device using a magnetic carrier substantially not triboelectrically chargeable with said magnetic toner and a toner triboelectrically chargeable by contact with the magnetic carrier to a polarity opposite to said magnetic toner.

DETAILED DESCRIPTION OF THE INVENTION

Figure 1:
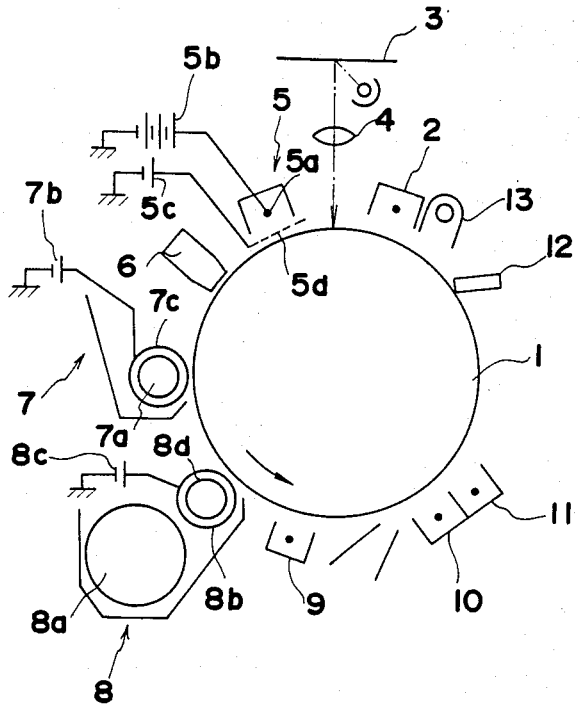
FIG. 1 is a diagram in section schematically showing the construction of a copying machine for forming dichromatic composite images by the method of the invention.

FIG. 1 shows a first embodiment of copying machine which is adapted to practice the method of forming the dichromatic copy images of the invention. A photosensitive drum 1 drivingly rotatable in the counter-clockwise direction is first uniformly charged to a specified polarity by a main corona charger 2. Subsequently the drum 1 is continuously exposed by an optical system 4 to a positive original 3 to form a first electrostatic latent image. The drum 1 is then charged by a scorotron charger 5 but this is to uniformly stabilize a background (non-image portion) potential of the first electrostatic latent as will be further explained hereinafter. The scorotron charger 5 comprises a corona electrode 5*a* connected a d.c. high voltage source 5*b* and a grid electrode 5*d* connected to a d.c. bias voltage source 5*c* and disposed between the corona electrode 5*a* and the drum 1. The bias voltage source 5*c* may be replaced by a constant voltage diode, discharge tube, ZnR or like constant voltage driven element.

The surface of the drum 1 having the first latent image formed thereon as described above is continuously exposed to a negative image by a light-emitting diode 6 to form a second latent image. More specifically, the drum surface is exposed to a negative image corresponding to electric signals delivered from an unillustrated image treating unit. The light-emitting diode 6 for forming the second latent image is replaceable by a laser scanner, OFT, liquid crystal array or the like as desired.

A first magnetic brush developing device 7 for developing the first electrostatic latent image and a second magnetic brush developing device 8 for developing the second electrostatic latent image are disposed adjacent to one another. The first magnetic brush developing device 7 uses a developer of at least a magnetic toner and provided with a rotatable sleeve 7*c* to which a first developing bias voltage source 7*b* is connected for applying a bias voltage Vb1 and a magnet roller 7*a* inside the sleeve 7*c*. The magnet roller 7*a* may either be rotatable or fixed and magnetic bristles are formed on the sleeve 7*c* to develop the first latent image. The second magnetic brush developing device 8 uses a mixture of magnetic carrier and non-magnetic toner as a developer. This mixture of carrier and toner is agitated by an agitating roller 8*a* and forms magnetic bristles on a rotatable sleeve 8*d*. The sleeve 8*d* is connected to a second developing bias voltage source 8*c* for appling a bias voltage Vb2 and is provided with a magnet roller 8*a* inside.

Prior to transfer, the toners deposited on the surface of the drum 1 are made to have the same polarity by a precharging corona charger 9. The toner image obtained by development is transferred to the surface of copy paper by a transfer corona charger 10. The charger 10 has attached thereto a separating corona charger 11 by which the copy paper bearing the transferred toner image on its surface is separated from the surface of the drum 1. The developer remaining on the surface of the drum 1 is removed therefrom by a cleaning blade 12, while the charges remaining on the drum surface are removed by an eraser lamp 13.

With the copying machine of the foregoing construction, the composite electrostatic latent image to be developed in two colors is formed in the following manner. In the first step, the photosensitive drum 1 is charged by the main corona charger 2 to an initial surface potential Vo, for example, of positive polarity as shown in FIG. 2*a*.

Figures 2A, 2B, 2C, 2D:
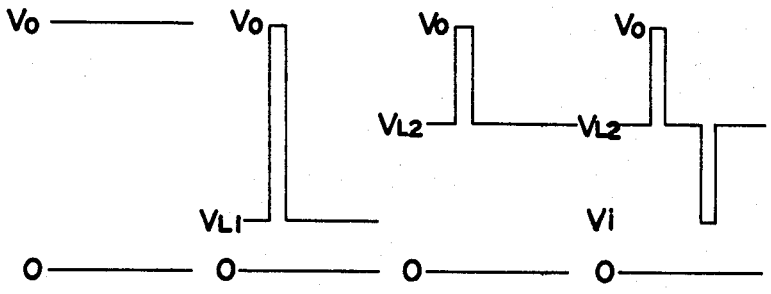
FIGS. 2*a* to 2*d* are diagrams showing the steps of forming a composite image by the copying machine of FIG. 1.

A second step is to expose the positive original 3 through the optical system 4 to the photosensitive drum 1 charged to the potential Vo and as shown in FIG. 2*b*, the potential of image area remains at substantially Vo but the nonimage area potential is attenuated to VL1. This potential VL1 is not always constant but is unstable because the sensitivity of the drum varies from drum to drum and further because of the variation of sensitivity due to temperature dependence and the variation in the amount of light for exposing the positive original 3. The unstability of the potential VL1 causes extreme difficulty in setting the developing bias voltage to be described later to a level nearly equal to or slightly higher than this potential, which inevitably results in fog.

In view of the above problem, the unstable potential VL1 is set to a stable intermediate level VL2 which is constant at all times, in the subsequent third step. To realize this by charging with the scorotron charger 5, the voltage Vg to be applied to the grid electrode 5*d* by the d.c bias voltage source 5*c* is set to a value higher than VL1 but sufficiently lower than the initial surface potential Vo. Thus the unstable potential VL1 is corrected to the stable constant intermediate potential VL2 which is approximately equal to Vg as shown in FIG. 2C by charging the nonimage area with the charger 5 to the same polarity as the charging of the first step. It is noted that the initial surface potential Vo is not influenced by this charging. Also, this third step is not necessary if the relatively stable potential of VL1 is assured. In this case, the potential VL1 should be about $\frac{1}{2}$ of the initial surface potential Vo.

In the fourth step, the portion of the drum 1 charged to the intermediate potential VL2 is exposed to a negative image to form the second latent electrostatic image, using a laser scanner, OFT, light-emitting diode array or like means 6 as already stated. The exposure to the negative image attenuates the intermediate potential VL2 to Vi in corresponding relation to the negative image area, forming the second latent image as seen in FIG. 2*d*. In this way, a composite electrostatic latent image composed of the three different potentials Vo, VL2 and Vi is formed on the drum 1 by the first to fourth steps. This composite electrostatic latent image is then developed into two colors by the first and second magnetic brush developing device 7 and 8, the details of which will be explained hereinafter.

Figure 3:
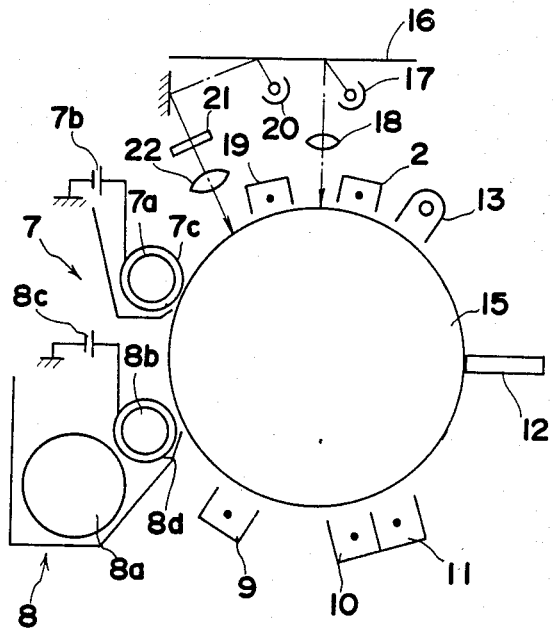
FIG. 3 is a diagram showing another embodiment of copying machine for forming dichromatic copy images from dichromatic originals by the method of the invention.

FIG. 3 shows a copying machine for forming a dichromatic image from a dichromatic original by the method of the present invention. The same parts as those shown in FIG. 1 will be referred to by the same corresponding numerals individually and will not be described.

With reference to FIG. 3, a photosensitive drum 15 which is sensitive to both positive and negative polarities and rotatable counterclockwise is first uniformly charged to a first polarity by a main corona charger 2. Subsequently a dichromatic original placed on a reciprocatingly movable carriage 16 is illuminated with an exposure lamp 17, and the image of the original is continuously projected onto the drum 15 through a lens 18, whereby a primary electrostatic latent image is formed. This latent image is then charged by a second corona charger 19 of second polarity. The same original is thereafter exposed to light by an exposure lamp 20, and the image of the original is projected on the drum through a cutoff filter 21 and a lens 22 to form a secondary electrostatic latent image.

Figure 4A:
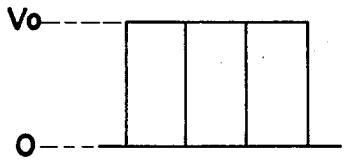
FIGS. 4*a* to 4*d* are diagrams showing the steps of forming a dichromatic copy image by the copying machine of FIG. 3.
Figure 4B:
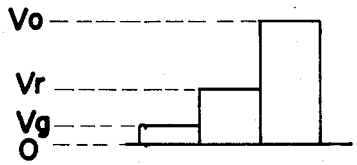
Figure 4C:
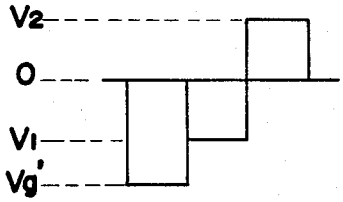
Figure 4D:
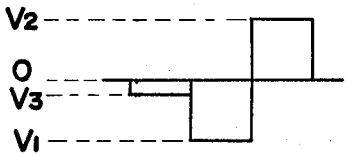

With the copying machine of the foregoing construction, the drum 15 during rotation is first uniformly charged by the main corona charger 2 to a surface potential Vo of positive polarity as shown in FIG. 4*a* (first step). Next, the drum 15 is exposed to the optical image of a dichromatic original to form a primary electrostatic latent image thereon as seen in FIG. 4*b* (second step). When the original includes a red image and a black image, the exposure attenuates the potential Vo to Vr in the portion corresponding to the red image area and to Vg approximate to 0 in the nonimage area (blank area), but the potential remains almost Vo in the black image area. The primary latent image having the potential pattern of Vo, Vr and Vg is charged by the second corona charger 19 to negative polarity to form the pattern of FIG. 4*c*(third step). Thus the lowest nonimage area potential Vg is inverted to Vg′ of negative polarity and the red image area potential Vr also to V1 of negative polarity by the negative charging, with the black image area potential Vo lowered to V2 and retaining the positive polarity. In this state, the drum 15 is exposed again to the optical image of the same original, through the red cutoff filter 21 at this time to thereby form a secondary electrostatic latent image of the potential pattern shown in FIG. 4*d* (fourth step). This exposure attenuates the nonimage area potential Vg′ to V3 approximate to 0, while permitting the red and black image area potentials V1 and V2 to remain unchanged.

The electrostatic latent images formed through the first to fourth steps by the copying machines of FIGS. 1 and 3 are then developed by the first and second magnetic brush developing device 7 and 8 into two colors. For this, the present invention uses for the first magnetic brush developing device 7 a developer including at least a magnetic toner triboelectrically chargeable to a specific polarity. This magnetic toner has a high resistivity of at least $10^{12}\Omega$.cm and can be prepared, for example, by mixing together an insulative resin and a fine magnetic powder in molten state, pulverizing the mixture after cooling and separating a fraction having a mean particle size of about 5 to 20 microns. Examples of useful resins are polyethylene, polyacrylic ester, polymethyl methacrylate, polystyrene, styrene-acrylic copolymer, epoxy resin, cumarone resin, maleic acid resin, phenolic resin, etc. Examples of useful fine magnetic powders are $Fe_2O_3$, $Fe_3O_4$, ferrite and like powders which are 0.1 to 5 $\mu$m in mean particle size. This magnetic toner may be used as a monocomponent developer and also as a two-component developer in combination with a magnetic carrier. In the case of the latter, the toner and the carrier are triboelectrically charged to opposite polarities by agitation.

As the developer for the second magnetic brush developing device 8, a magnetic carrier and a non-magnetic toner triboelectrically chargeable by the magnetic carrier are used. The magnetic carrier of this developer is substantially not triboelectrically chargeable by contact with said magnetic toner. In this regard, the property of the magnetic toner that it is substantially not triboelectrically chargeable by contact with the magnetic carrier can be defined in terms of the absolute value of the amount of charge on the magnetic toner which is up to 2.0 $\mu$c/g, preferably up to 1.0 $\mu$c/g, as determined by a method of measuring the amount of film development charge, i.e., by developing the surface of an insulating film charged to a polarity opposite to the polarity of charges on the magnetic toner with a thoroughly agitated mixture of the magnetic toner and the magnetic carrier and determining the amount of charge on the toner from the resulting reduction of the surface potential on the film and the amount of toner deposited on the film surface. If the amount of charge on the toner is very small, no toner will be deposited on the surface of the insulating film, making it impossible to measure the amount of charge on the toner. However, the deposition of no toner indicates that the toner is not charged.

The magnetic carrier, which does not triboelectrically charge with the magnetic toner, desirably has a resistivity of at least $10^{12}\Omega$.cm and a mean particle size of about 25 to 50 microns. To assure that the magnetic carrier be not triboelectrically chargeable by contact with the magnetic toner, it is possible, for example, to prepare this magnetic carrier from the same composition as the magnetic toner. However, it is desirable to increase the degree of magnetization and about 50 to 75 weight % of the fine magnetic powder should be dispersed in the insulative resin.

On the other hand, the non-magnetic toner is triboelectrically charged to a polarity opposite to the polarity of said magnetic toner by contact with the magnetic carrier and has a resistivity of at least $10^{14}\Omega$.cm and a mean particle size of 5 to 20 microns. A suitable known toner is usable and when required, it can be magnetic.

With the above developers using the magnetic toner of mono-component type negatively charged and colored black and the non-magnetic toner of positive polarity triboelectrically charged by the magnetic carrier (therefore the magnetic carrier is charged negative) and colored red, the composite electrostatic latent image formed through the first to fourth steps (FIGS. 2*a* to 2*d*) by the copying machine of FIG. 1 is developed dichromatically in the following manner.

Figure 5A:
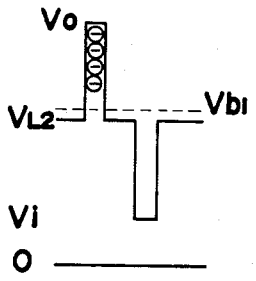
FIGS. 5*a* and 5*b* are diagrams showing the steps of developing an electrostatic latent image formed by the copying machine of FIG. 1.

The first latent image portion represented by the potential Vo relative to the intermediate potential VL2 of the composite electrostatic latent image formed in FIG. 2*d* is developed by the first magnetic brush developing device 7. The above described magnetic toner is accommodated in this first developing device 7 and the developing bias voltage Vb1 set at a value slightly higher than the intermediate potential VL2 is applied to the sleeve 7*c* from the first developing bias voltage source 7*b*. By this means, the first latent image portion is developed by normal development with the magnetic toner adhering to the portions having a potential higher than the bias voltage Vb1 as shown in FIG. 5*a*.

Figure 5B:
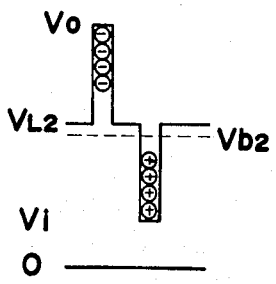

Next the second latent image represented by the potential Vi relative to the intermediate potential VL2 is developed by the second magnetic brush developing device 8. This is effected as shown in FIG. 5*b* by applying to the sleeve 8*d* the bias voltage Vb2 of a value slightly lower than the intermediate potential VL2 from the second developing bias voltage source 8*c* and as the result, the non-magnetic toner is adhered at the image portion of the potential below Vb2. During the development by the second magnetic brush developing device 8, the magnetic brush bristles formed on the sleeve 8*c* rubbingly contact with the toner image on the photosensitive drum 1 already developed by the first magnetic brush developing device 7 and this in turn causes the scraping off of a small quantity of the magnetic toner from the toner image whereby the magnetic toner is mixed into the second magnetic brush developing device 8. However, even if the magnetic toner is mixed in, no poor quality image due mingling of colors will occur in the present invention.

Explaining this in detail, the magnetic toner will not triboelectrically charge with the magnetic carrier as described above. Accordingly, although the magnetic toner contacts the magnetic carrier magnetically, the contact thereof will not cause the magnetic carrier to be triboelectrically charged. This means that the charging polarity of the magnetic carrier will not be destroyed or changed thereby always retaining the predetermined charging polarity (in this case negative polarity). Thus the non-magnetic toner which is triboelectrically charged to the polarity (positive polarity) opposite to that of the magnetic carrier also always retains its polarity and the magnetic toner also maintains the predetermined polarity (negative). Accordingly, even if the magnetic toner is mixed into second magnetic brush developing device 8, no mingling of colors by adhesion of the non-magnetic toner to the first latent image and no adhesion of the magnetic toner to the second latent image will occur so that the dichromatic images free of fog and scattering of toner can be obtained. In this way, the present invention has made possible in term of the developer to always maintain the predetermined triboelectrical charging polarities of the magnetic toner, magnetic carrier and the non-magnetic toner and permitting the magnetic toner of the first magnetic brush developing device to mix into the second magnetic brush developing device without causing the mingling of colors in the dichromatic images.

After the dichromatic image is developed, the drum 1 is charged to negative polarity opposite to that of the first step by the precharging corona charger 9, whereby the two kinds of toners of different polarities are made to have the same polarity. However, when pressure or heat is used for transfer, the precharging corona charger can be dispensed with. Subsequently positive corona ions are applied to the rear side of the copy paper by the transfer corona charger 10 to transfer the developed image onto the paper. The copy paper is then separated from the drum by the separating corona charger 11 and fed to an unillustrated fixing unit, by which the image is fixed to give a finished copy. On the other hand, the developer remaining on the drum 1 is removed by the cleaning blade 12, and the residual charges are eliminated by the eraser lamp 13 to render the drum 1 ready for the next copying cycle.

Figure 6A:
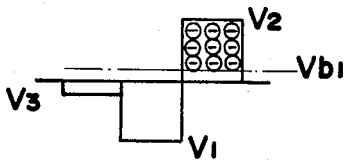
FIGS. 6*a* and 6*b* are diagrams showing the steps of developing an electrostatic latent image formed by the copying machine of FIG. 3.
Figure 6B:
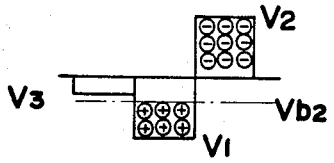

Explaining now the development of the electrostatic latent image formed by the steps of FIGS. 4*a* to 4*d* using the copying machine of FIG. 3, the black image area represented by the potential V2 is first developed by the first magnetic brush developing device 7. This is effected by adhering the magnetic toner by the normal development while applying to the sleeve 7*c* the bias voltage Vb1 slightly higher than OV from the first developing bias voltage source 7*b* as shown in FIG. 6*a*. The red image area represented by the potential V1 is then developed by the second magnetic brush developing device 8 while applying to the sleeve 8*d* the bias voltage Vb2 from the second developing bias voltage source 8*c* set at a value slightly higher than the nonimage area potential V3. By this means, the non-magnetic toner is adhered by the normal development on the portion between V3 and V1 as shown by FIG. 6*b*. Even if the magnetic toner is mixed into the second developing device 8 during the development of the red image area, the dichromatic images obtained will be free of mingling of colors as explained above.

With respect to the description given so far, the steps for forming the electrostatic latent images are not limited to those copying machines shown in FIGS. 1 and 3, but various methods such as those shown in Published Unexamined Japanese Patent Application No. SHO 55-117155 and U.S. Pat. No. 4,335,194 can be used. Also for the magnetic brush developing devices 7 and 8, the magnet rollers 7*a* and 8*a* may be rotated with the sleeves fixed or vice-versa or even both the sleeve and the magnet roller may be rotated.

The present invention will be described more specifically with reference to the following experimental examples.

EXPERIMENTAL EXAMPLE 1

In the copying machine shown in FIG. 1, the photosensitive drum 1 was prepared by dispersing a photoconductive fine powder of $CdS.nCdCO_3$ in thermosetting acrylic resin with a solvent, applying the dispersion to the surface of an aluminum drum 80 mm in diameter to form a 30-micron-thick photoconductive layer over the drum surface, and laminating an insulating protective layer of acrylic resin, up to 0.5 micron in thickness, to the layer. The surface of the photosensitive drum 1 was positively uniformly charged to 600 V by the main corona charger 2 and then exposed to a positive image 3 through the optical system 4 to form a first latent image having an image area potential Vo of 600 V in FIG. 2*b*. Subsequently the nonimage area of the drum 1 was charged to an elevated intermediate potential VL2 of 350 V by the charger 5 as shown in FIG. 2*c* and exposed to a negative image by the light-emitting diode 6 to form a second latent image having an image area potential Vi of 100 V as shown in FIG. 2*d*. The first and second latent images were then developed by the first and second magnetic brush developing devices 7, 8 respectively and transferred onto the copying paper to obtain the dichromatic copy image.

A mono-component magnetic toner was used as the developer for the first magnetic brush developing device 7. This magnetic toner having a mean particle size of 13 microns and a resistivity of $10^{13}\Omega$.cm was prepared from the following ingredients:

| | |
|---|---|
| styrene-acrylic copolymer ("HYMER-SBM73," product of Sanyo Kasei Co., Ltd.) | 100 parts by weight |
| fine magnetic powder ("MAGNETITE RB-BL," product of Chitan Kogyo Co., Ltd.) | 80 parts by weight |
| carbon black ("MA#100," product of Mitsubishi Kasei Co., Ltd.) | 5 parts by weight |
| charge control dye ("NYGROSINE", product of Orient Kagaku Co., Ltd.) | 2 parts by weight |
| fluidifying agent (silica) ("#200", product of Japan Aerosil Co., Ltd.) | 0.2 parts by weight |

by mixing the ingredients together in a molten state, pulverizing the mixture after cooling and screening the resulting particles for classification. The magnetic toner obtained in this way is triboelectrically charged to a negative polarity by contact with the sleeve 7*c* which is made of stainless steel. During the development, both the sleeve 7*c* and the magnet roller 7*a* were rotated at different speeds and the bias voltage Vb1 of 400 V which is somewhat higher than the intermediate potential of 350 V was applied to the sleeve 7c to develop the first latent image.

A mixture of the magnetic carrier and the non-magnetic toner in a weight ratio of about 5 to 1 was used as the developer for the second magnetic brush developing device 8. The magnetic carrier having a mean particle size of 40 microns and a resistivity of $10^{13}\Omega$.cm was prepared similarly to the magnetic toner from the following ingredients:

| | |
|---|---|
| styrene- acrylic copolymer ("HYMER SBM-73") | 100 parts by weight |
| fine magnetic powder ("MAGNETITE RB-BL") | 150 parts by wieght |
| carbon black ("MA#100") | 4 parts by weight |
| charge control dye ("NYGROSINE") | 2 parts by weight |

Since this magnetic carrier is prepared from basically same compositions as the magnetic toner, no triboelectrical charging will take place with respect to one another.

The non-magnetic toner having a mean particle size of 12 microns and a resistivity of $10^{15}\Omega$.cm was prepared from the following ingredients:

| | |
|---|---|
| styrene-acrylic copolymer ("PLIOLITE AC", product of The Goodyear Tire & Rubber Co.) | 100 parts by weight |
| red color charge control dye | 6 parts by weight |

This non-magnetic toner triboelectrically charges to the positive polarity by contact with the magnetic carrier. Using this developer for the second magnetic brush developing device 8, the developer was thoroughly agitated by the agitating roller 8a to form the magnetic brush bristles on the sleeve 8d and the second latent image was developed by reverse development. During the development, the bias voltage Vb2 of 300 V which is somewhat lower than the intermediate potential VL2 of 350 V was applied to the sleeve 8d from the second developing bias voltage source 8c. The first and second latent images developed were then subjected to negative charging by the precharging corona charger 9 and subsequently transferred onto the copying paper by the transfer corona charger 10.

The dichromatic copy image obtained was satisfactory in image density and quality and free from fog, indicating that the first and second latent images were reproduced with high fidelity. Particularly, no mingling of colors were observed at all and when repeatedly copied, dichromatic images of good qualities were obtained. Although a small quantity of the magnetic toner was found inside the second magnetic brush developing device 8, the fact that no mingling of colors occured in the dichromatic images produced proves that the triboelectrical charging characteristics of the magnetic toner, magnetic carrier and non-magnetic toner are not destroyed and always maintained with the predetermined polarities. In other words, the magnetic toner mixing into the second developing device will be held magnetically to the magnetic carrier without being triboelectrically charged.

EXPERIMENTAL EXAMPLE 2

In this experiment, a two-component developer of a mixture of said magnetic toner and a magnetic carrier which triboelectrically charges with the magnetic toner was used for the first magnetic brush developing device 7. This magnetic carrier had a mean particle size of 37 microns and was prepared from the following ingredients:

| | |
|---|---|
| styrene-acrylic copolymer ("PLIOLITE AC") | 100 parts by weight |
| fine magetic powder ("MAGNETITE") | 200 parts by weight |
| carbon black ("MA#100") | 4 parts by weight |

Other conditions were same as Experimental Example 1. The dichromatic images obtained were free of fog and mingling of colors.

EXPERIMENTAL EXAMPLE 3

Using the copying machine shown in FIG. 3 with the photosensitive drum 15 the same as the one described in Example 1, the photosensitive drum 15 was first charged to a uniform surface potential of 800 V by the main corona charger 2. Subsequently, a dichromatic original placed on the carriage 16 was successively exposed, then charged to negative by the second corona charger 19 and then again exposed to the same original to form a secondary electrostatic latent iamge. The potentials for this latent iamge in FIG. 4d were about 300 V for V2, −200 V for V1 and −50 V for V3.

Using the same developers described in Example 1 both for the first and second magnetic brush developing devices 7 and 8, the black image area represented by V2 was first developed by the first magnetic brush developing device 7 while applying the bias voltage Vbl of 40V to the sleeve 7c. By this means, the magnetic toner adhered on the black image area above Vb1. The red image area represented by V1 was then developed by the second developing device 8 with the Vb2 set to −70 V. The dichromatic copy image obtained was satisfactory in image density and quality and was free from fog. Particularly, no mingling of color was observed at all and dichromatic images of good quality were obtained even during continuous copying.

Numerous modifications and variations of the present invention are possible in light of the above teachings and, therefore, within the scope of the appended claims, the invention may be practiced otherwise than particularly described.

What is claimed is:

1. A method of forming dichromatic copy images comprising a first step of forming an electrostatic latent image having a potential pattern to be developed in a first color and a potential pattern to be developed in a second color, a second step of developing said first color potential pattern by a first magnetic brush developing device using at least a magnetic toner of first color triboelectrically chargeable to a specific polarity, a third step of developing said second color potential pattern by a second magnetic brush developing device using a magnetic carrier substantially not triboelectrically chargeable with said magnetic toner and a toner of a second color triboelectrically chargeable to a polarity opposite to said magnetic toner by contact with the magnetic carrier, and a fourth step of transferring the developed image.

2. A method of forming dichromatic copy images comprising:

a first step of forming an electrostatic latent image having at least three different levels of potentials with a first level representing a first image portion, a second level representing a second image portion and a third level between the first and second levels representing a background portion for the first and second image portions;

a second step of developing said first image portion by a first magnetic brush developing means using a magnetic toner of a first color triboelectrically chargeable to a specific polarity;

a third step of developing said second image portion by a second magnetic brush developing means using a magnetic carrier substantially not triboelectrically chargeable with said magnetic toner and a toner of a second color triboelectrically chargeable to a polarity opposite to that of the magnetic toner by contact with the magnetic carrier; and a fourth step of transferring the image developed by said second and third steps onto a copying paper.

3. A method as claimed in claim 2 wherein said first and second image portions as well as said background portion are all in same polarity.

4. A method as claimed in claim 2 wherein said first and second image portions are different in polarity.

5. A method as claimed in claim 2 wherein said magnetic carrier contains about 50 to 70 weight % of fine magnetic powder dispersed in resin and having a resistivity of at least $10^{12}\Omega$.cm.

6. A method as claimed in claim 5 wherein said magnetic toner is prepared by dispersing fine magnetic powder in resin and the proportion of the dispersion is less than the proportion of the fine magnetic powder contained in said magnetic carrier.

* * * * *